US008289816B2

(12) United States Patent
Kato et al.

(10) Patent No.: US 8,289,816 B2
(45) Date of Patent: Oct. 16, 2012

(54) CHRONOGRAPH TIMEPIECE

(75) Inventors: Kazuo Kato, Chiba (JP); Akira Takakura, Chiba (JP); Kenji Ogasawara, Chiba (JP); Saburo Manaka, Chiba (JP); Kazumi Sakumoto, Chiba (JP); Hiroshi Shimizu, Chiba (JP); Tomohiro Ihashi, Chiba (JP); Keishi Honmura, Chiba (JP); Takanori Hasegawa, Chiba (JP); Kosuke Yamamoto, Chiba (JP); Eriko Noguchi, Chiba (JP)

(73) Assignee: Seiko Instruments Inc. (JP)

( * ) Notice: Subject to any disclaimer, the term of this patent is extended or adjusted under 35 U.S.C. 154(b) by 146 days.

(21) Appl. No.: 12/927,305

(22) Filed: Nov. 10, 2010

(65) Prior Publication Data

US 2011/0122734 A1 May 26, 2011

(30) Foreign Application Priority Data

Nov. 25, 2009 (JP) ..... 2009-267577

(51) Int. Cl.
*G04F 8/00* (2006.01)
*G04F 10/00* (2006.01)

(52) U.S. Cl. ..... 368/110; 368/112

(58) Field of Classification Search ..... 368/101, 368/106, 110–113
See application file for complete search history.

(56) References Cited

U.S. PATENT DOCUMENTS

| | | | | |
|---|---|---|---|---|
| 6,466,518 | B1 * | 10/2002 | Akahane et al. | 368/64 |
| 6,724,692 | B1 * | 4/2004 | Akahane et al. | 368/204 |
| 7,170,826 | B2 * | 1/2007 | Furukawa et al. | 368/80 |
| 7,215,603 | B2 * | 5/2007 | Koike | 368/223 |
| 2003/0137900 | A1 * | 7/2003 | Akahane et al. | 368/110 |

OTHER PUBLICATIONS

Abstract, Publication No. JP2005003493, Publication date Jan. 1, 2005.

* cited by examiner

*Primary Examiner* — Vit W Miska
(74) *Attorney, Agent, or Firm* — Adams & Wilks

(57) ABSTRACT

Disclosed is a chronograph timepiece whose chronograph hands are electrically drive-controlled and mechanically zero-restoring-controlled, wherein it possible to perform a normal operation at the time of start operation and reset operation. After a mechanical control unit releases the setting of chronograph hands in response to the start operation of a start/stop button, a contact portion is placed in a start state, and an electrical control unit starts a time measurement operation to electrically hand-movement-drive the chronograph hands, and, after a contact portion is placed in a reset state in response to a reset operation of a reset button and the electrical control unit electrically resets the time measurement operation, the mechanical control unit mechanically zero-restores and sets the chronograph hands.

4 Claims, 5 Drawing Sheets

CHRONOGRAPH TIMEPIECE

BACKGROUND OF THE INVENTION

1. Field of the Invention

The present invention relates to a chronograph timepiece having a time indicating function and a time measuring function.

2. Description of the Related Art

Conventionally, there has been developed a chronograph timepiece in which a plurality of driving motors are mounted to respectively drive a plurality of hands and which is endowed with a time indicating function as a basic function and, further, a chronograph function to perform time measurement, wherein the driving of the hands is effected electrically by the driving motors, with the zero-restoring and setting of the chronograph hands being effected by a mechanical mechanism such as a heart (See, for example, JP-A-2005-3493).

In the invention as disclosed in JP-A-2005-3493, to prevent a malfunction, the following order is adopted in performing the zero-restoring operation: the input of a reset signal, the setting of a chronograph train wheel, and the zero-restoring (See paragraph [0030]); further, to eliminate a start error, the following order is adopted as the optimum timing in effecting the chronograph (time measurement) start: the releasing of zero-restoring or the releasing of setting, and a start switch input operation (See paragraph [0037]).

Accordingly, there are involved restrictions in terms of the switch input contact mechanism, so that the structures of levers and of switch springs are rather complicated.

Further, in a case where a reset operation is performed during the time measurement operation, if the setting is effected before a reset switch has been turned on to stop the hand movement, the motors cannot rotate, and the motor rotating positions and polarities stored in a motor drive circuit do not coincide with each other, with the result that the hand movement is impossible at the time of re-starting of the chronograph operation.

Further, in the chronograph start operation, if a start switch is turned on to start the motor driving before the setting has been released through a variation in the mechanism, the hand movement will be impossible even when the motors rotate. This problem is conspicuous when the hand movement cycle is short as in the case of a chronograph timepiece.

SUMMARY OF THE INVENTION

It is an aspect of the present invention to provide a chronograph timepiece whose chronograph hands are electrically drive-controlled and mechanically zero-restoring-controlled, wherein it is possible to perform a normal operation at the time of start operation and reset operation.

According to the aspect of the present invention, there is provided a chronograph timepiece comprising: a mechanical control unit releasing a mechanical setting of a chronograph hand in response to a start operation of an operation unit and mechanically zero-restoring and setting the chronograph hand in response to a reset operation of the operation unit; a switch unit operating in response to the operation of the operation unit; and an electrical control unit which starts a time measurement operation to electrically hand-movement-drive the chronograph hand when the switch unit is placed in a start state through the start operation of the operation unit and which electrically resets the time measurement operation when the switch unit is placed in a reset state through a reset operation of the operation unit, wherein the switch unit is placed in the start state after the mechanical control unit releases the setting of the chronograph hand in response to the start operation of the operation unit, and the electrical control unit starts the time measurement operation to electrically hand-movement-drive the chronograph hand; and, the mechanical control unit mechanically zero-restores and sets the chronograph hand after the switch unit is placed in the reset state and the electrical control unit electrically resets the time measurement operation in response to the reset operation of the operation unit.

In the chronograph timepiece of the present invention, the timing of the electrical operation and the mechanical operation at the time of start operation and reset operation is optimized, so that it is possible to perform a normal operation.

DETAILED DESCRIPTION OF THE PREFERRED EMBODIMENTS

Figure 3:
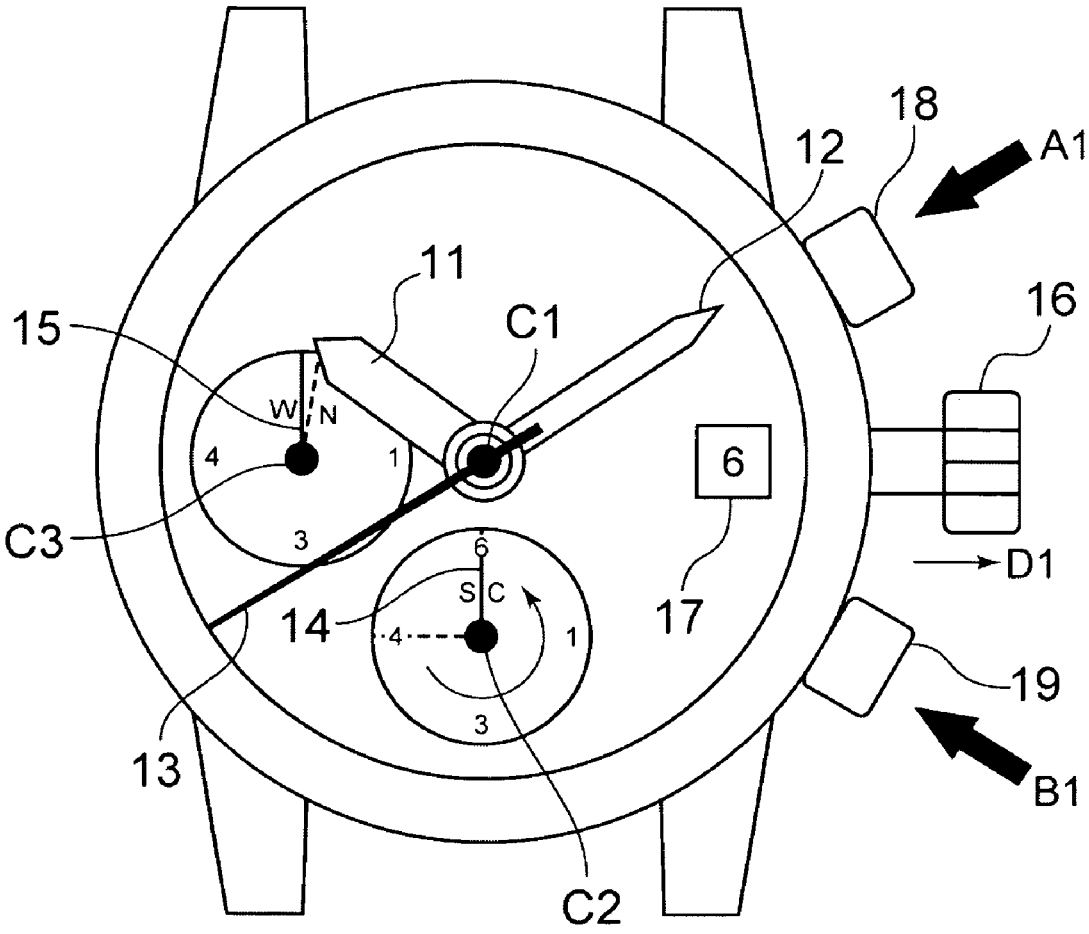
FIG. 3 is an external plan view of a chronograph timepiece according to embodiments of the present invention.

As shown in FIG. 3, a chronograph timepiece 1 according to an embodiment of the present invention is in the form of a wristwatch, and is equipped with time hands (an hour hand 11, a minute hand 12, and a second hand 13) rotated around a center axis C1 and indicating the current time, and chronograph hands (a chronograph second hand 14 rotated around a center axis C2 and a chronograph minute hand 15 rotated around a center axis C3).

For example, by turning a winding stem 16 in a state in which it has been drawn out two steps in a direction D1, the time hands 11 through 13 can be rotated, and, by turning the winding stem 16 in a state in which it has been drawn out one step in the direction D1, it is possible to change a date 17 of a date indicator displayed through a window. The operation of the chronograph timepiece 1 related to usual time display is the same as that of an ordinary electronic timepiece, and is well known to those skilled in the art, so that, in the following, a description of the structures, functions, and operations related to the usual hand movement will be omitted.

In the chronograph timepiece 1, the chronograph hands 14 and 15 are electrically drive-controlled by stepping motors, and are zero-restoring-controlled by a mechanical construction.

In the chronograph timepiece 1, by depressing a start/stop button 18 in a direction A1, an instruction is given to effect the starting and stopping of a chronograph operation by the chronograph timepiece 1. More specifically, the starting/stopping of the chronograph operation means the starting/stopping of the hand movement of the chronograph hands 14 and 15; as described below, in relation to this, the operation of an electrical drive system and the retention of electrical positional information on the chronograph hands 14 and 15 are effected. However, in some cases, there is no need to retain electrical positional information on the chronograph hands 14 and 15.

Further, in the chronograph timepiece 1, by depressing a reset button 19 in a direction B1, there is given an instruction to reset the chronograph operation by the chronograph timepiece 1, i.e., to restore the chronograph timepiece to the initial state (zero-restoring). More specifically, the resetting of the chronograph operation means a forcible restoring (zero-restoring) of the chronograph hands 14 and 15 to the initial positions (time indicating positions), the setting of the hand movement of the chronograph hands 14 and 15, and the resetting of the electrical positional information on the chronograph hands 14 and 15. More specifically, as the electrical resetting of the chronograph operation, there are performed a measurement time reset operation and a motor drive stopping operation.

The start/stop button 18 and the reset button 19 constitute operation units.

First, a mechanical structure 5 and an operation related to the starting, hand movement, and zero-restoring of the chronograph timepiece 1 will be described mainly with reference to FIGS. 2A and 2B. The mechanical structure 5 related to the starting, hand movement, and zero-restoring of the chronograph timepiece 1 is also shown schematically in the left-hand side portion of the block diagram of FIG. 1.

Apart from a motor (not shown) for usual hand movement (for time hand movement), the chronograph timepiece 1 is equipped with a chronograph hand movement motor 35; when it is driven to rotate, the chronograph hand movement motor 35 moves the chronograph hands 14 and 15 via a chronograph hand movement train wheel 36.

The motor for usual hand movement and the chronograph hand movement motor 35 are stepping motors of a well-known structure that are used for timepieces. Each of stepping motor is equipped with a stator having a rotor accommodation hole and a positioning portion determining a rotor stopping position, a rotor arranged in the rotor accommodation hole, and a driving coil, and rotates the rotor by generating a magnetic flux in the stator through supply of alternating signals (drive pulses) of alternating polarities to the driving coil, and, at the same time, stops the rotor at a position corresponding to the positioning portion. Each time it is alternately driven by drive pulses of different polarities, the rotor is rotated by a predetermined angle at one time (e.g., 180 degrees). If the rotor is continuously driven by a plurality of in-phase drive pulses, in the case where it is rotated by the first drive pulse, the rotor is not rotated by the second in-phase pulse onward.

The chronograph timepiece 1 is equipped with a chronograph second cam 22 mounted to a chronograph second arbor 21 with the chronograph second hand 14, and a chronograph minute cam 24 mounted to a chronograph minute arbor 23 with the chronograph minute hand 15.

Further, the chronograph timepiece 1 is equipped with a hammer operating first lever (hereinafter also referred to as the "hammer operating lever B") 25, a hammer operating second lever (hereinafter also referred to as the "hammer operating lever A") 26, a hammer 27, and a stop lever 28.

The chronograph second cam 22, the chronograph minute cam 24, and the hammer 27 constitute a setting mechanism. Further, the hammer operating second lever 26 and the hammer 27 constitute a first lever unit, and the hammer operating first lever 25, the hammer operating second lever 26, and the hammer 27 constitute a second lever unit.

The hammer operating first lever 25 is rotatable between a reference position J1 (indicated by a solid line in FIG. 2B) and a zero-restoring position J2 (indicated by a solid line in FIG. 2A and by a dashed line in FIG. 2B); it is engaged with a spring-like positioning member 29 provided with a groove with which a positioning pin 25*a* is engaged, and is fixed in position at the reference position J1 or the zero-restoring position J2. An elongated hole 26*a* of the hammer operating second lever 26 is engaged with a pin 25*b* of the hammer operating first lever 25. When the hammer operating first lever 25 is moved from the reference position J1 to the zero-restoring position J2 and set in position, the hammer operating second lever 26 is moved from a reference position K1 (indicated by a solid line in FIG. 2B) to a zero-restoring position K2 (indicated by a solid line in FIG. 2A and by a dashed line in FIG. 2B).

On the other hand, when the hammer operating second lever 26 is moved from the zero-restoring position K2 to the reference position K1 and set in position, the hammer operating first lever 25 is moved from the zero-restoring position J2 to the reference position J1 and fixed in position.

Figure 2A:
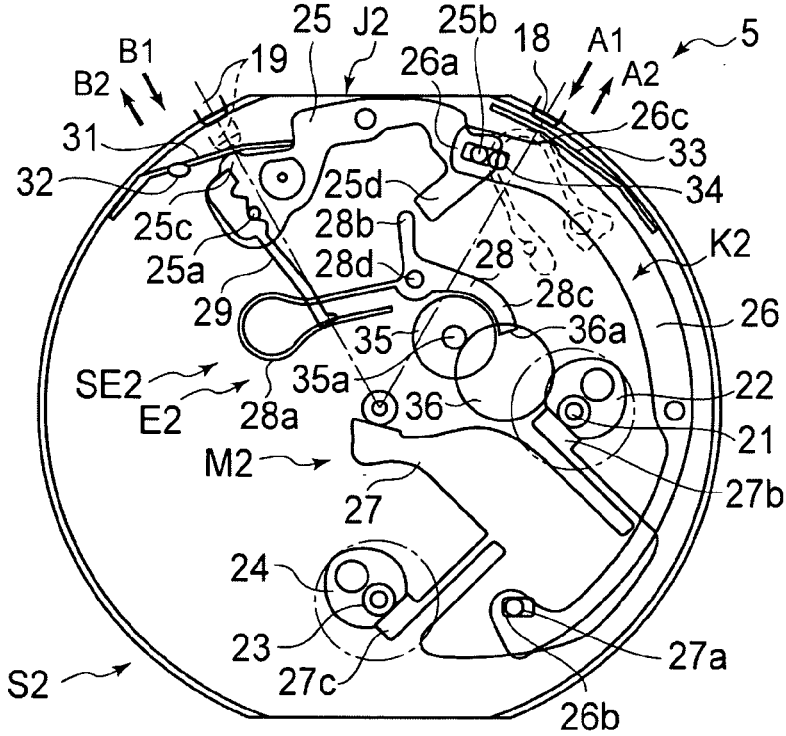
FIGS. 2A and 2B are schematic plan views of the mechanical configuration of a chronograph mechanism of the chronograph timepiece of the first embodiment of the present invention.
Figure 2B:
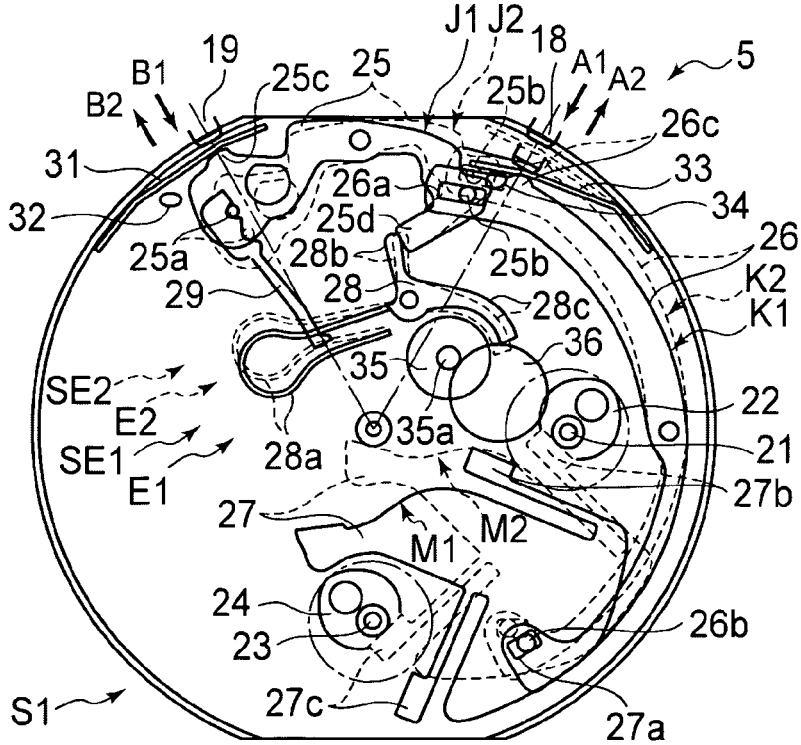

An elongated hole 27*a* of the hammer 27 is engaged with a pin 26*b* of the hammer operating second lever 26, and, according to the position setting of the hammer operating second lever 26 at the reference position K1 or the zero-restoring position K2, the hammer 27 is fixed in position at a reference position M1 (indicated by a solid line in FIG. 2B) or a zero-restoring position M2 (indicated by a solid line in FIG. 2A and by a dashed line in FIG. 2B).

When the hammer 27 is set at the zero-restoring position M2, a second hammer portion 27*b* of the hammer 27 strikes the chronograph second cam 22 to zero-restore the chronograph second hand 14 to the initial position, and a minute hammer portion 27*c* thereof strikes the chronograph minute cam 24 to zero-restore the chronograph minute hand 15 to the initial position.

The stop lever 28 is equipped with a spring portion 28*a*, an engagement arm portion 28*b*, and a lock arm portion 28*c*, and is rotatable around a pin 28*d* between a correction control position or setting position E2 at the time of zero-restoring (indicated by a solid line in FIG. 2A and by a dashed line in FIG. 2B) and a correction control releasing position or setting releasing position E1 (indicated by a solid line in FIG. 2B). In a state SE2 in which the stop lever 28 is at the setting position E2, the lock arm portion 28*c* of the stop lever 28 is engaged with one of wheels 36*a* of a chronograph hand movement train wheel 36 connected to a rotor gear 35*a* of the chronograph hand movement motor 35 to thereby set the rotation of the train wheel 36; and, in a state SE1 in which the stop lever 28 is at the setting releasing position E1, it is separated from the wheel 36*a* of the train wheel 36, and permits rotation of the rotor gear 35*a* of the motor 35 and of the train wheel 36.

When the hammer operating first lever 25 is displaced through rotation from the zero-restoring position J2 to the reference position J1, the engagement arm portion 28*b* of the stop lever 28, whose spring portion 28*a* is under a biasing force in the direction of the setting position E2, is engaged with an arm portion 25*d* of the hammer operating first lever 25 to be displaced through rotation from the setting position E2 at the time of zero-restoring to the setting releasing position E1. On the other hand, when the hammer operating first lever 25 is moved from the reference position J1 to the zero-restoring position J2, the engagement between the arm portion 25*d* of the hammer operating first lever 25 and the engagement arm portion 28*b* is released, so that the stop lever 28 is restored from the setting releasing position E1 to the setting position E2 by the resilient force of the spring portion 28*a*.

When the chronograph timepiece 1 is in a zero-restoring (resetting) state S2 shown in FIG. 2A, if the start/stop button 18 is depressed in the direction A1, a protrusion 26*c* of the hammer operating second lever 26 is pressed in the direction. A1, and the hammer operating second lever 26 is displaced from the position K2 to the position K1; at the same time, the hammer operating first lever 25 is displaced from the position J2 to the position J1, and the hammer 27 is displaced from the position M2 to the position M1. As a result, the rotation setting (zero-restoring control) of the hearts 22 and 24 and the chronograph hands 14 and 15 by the hammer portions 27*b* and 27*c* is released. Further, in response to the rotation of the hammer operating first lever 25 from the position J2 to the position J1, the stop lever 28, whose arm portion 28*b* is engaged with the arm portion 25*d* of the hammer operating first lever 25, is rotated from the setting position E2 to the setting releasing position E1, and the lock arm portion 28*c* of the stop lever 28 is separated from the chronograph train wheel 36 to release the rotation setting (stop control) of the train wheel 36. As a result, the mechanical control mechanism 5 is restored to the state S1, and the chronograph hands 14 and 15 become rotatable.

On the other hand, when the chronograph timepiece 1 is in the start state or hand movement state S1 shown in FIG. 2B, if the reset button 19 is depressed in the direction B1, the protrusion 25*c* of the hammer operating first lever 25 is pressed in the direction B1, and the hammer operating first lever 25 is displaced from the position J1 to the position J2. When the hammer operating first lever 25 is displaced from the position J1 to the position J2, the hammer operating second lever 26 engaged with the lever 25 is moved from the position K1 to the position K2, and the hammer 27 engaged with the lever 26 moves from the position M1 to the position M2 on the one hand, with the second hammer 27*b* and the minute hammer 27*c* striking the second heart 22 and the minute heart 24 to zero-restore the chronograph secondhand 14 and the chronograph minute hand 15; on the other hand, the lock of the arm portion 25*d* to the stop lever 28 is released, and the stop lever 28 is rotated from the position E1 to the position E2, with the arm portion 28*c* thereof being engaged with the chronograph train wheel 36 to set the train wheel 36.

Regarding the chronograph timepiece 1, the electrical aspect thereof will be described as follows within the range thereof related to the mechanical structure 5 shown in FIGS. 2A and 2B.

When the chronograph timepiece 1 is in the reset state S2 shown in FIG. 2A, if the start/stop button 18 is depressed in the direction A1 (that is, if start operation is performed), the start/stop button 18 presses a start/stop switch spring 33 exerting a biasing force in a direction A2 in the vicinity of the depth end thereof to close a contact portion 34, generating a start signal Pa (FIG. 1) via the contact portion 34.

In this embodiment, the levers 25, 26, and 27, the start/stop switch spring 33, and the contact portion 34 are arranged in a positional relationship such that after the setting releasing of the train wheel 36 (in other words, the setting releasing of the chronograph hands 14 and 15) at the time of start operation, the start/stop switch spring 33 closes the contact portion 34.

When the chronograph timepiece 1 is in the start state S1 shown in FIG. 2B, if the start/stop button 18 is depressed in the direction A1, the start/stop button 18 presses the start/stop switch spring 33 to close the contact portion 34, generating a stop signal Pb (FIG. 1) via the contact portion 34.

On the other hand, when the chronograph timepiece 1 is in the start state (or stop state) S1 shown in FIG. 2B, if the reset button 19 is depressed in the direction B1, the reset button 19 presses a reset switch spring 31 exerting a biasing force in a direction 32 in the vicinity of the depth end thereof to close a contact portion 32, generating a reset signal Qa (FIG. 1) via the contact portion 32.

In this embodiment, the levers 25, 26, and 27, the reset switch spring 31, and the contact portion 32 are arranged in a positional relationship such that the setting of the train wheel 36 (in other words, the zero-restoring and setting of the chronograph hands 14 and 15) is effected after the start/stop switch spring 33 closes the contact portion 34 at the time of reset operation.

A more detailed description will be given, centering on the start and progress of the start operation when the start/stop button 18 is depressed in the direction A1 in the zero-restoring state S2 of FIG. 2A. As the start/stop button is depressed in the direction A1, the mechanical zero-restoring control state is released through rotation of the hammer 27 as a result of the rotation of the hammer operating second lever 26, and, at the same time, the lock (stop control state) of the train wheel 36 is released through rotation of the stop lever 28 as a result of the rotation of the hammer operating second lever 26 and the hammer operating first lever 25 to mechanically permit the hand movement (i.e., to release the mechanical setting); after this, an electric drive start signal Pa is output via the switch contact 34, thereby rotating the motor 35.

Figure 1:
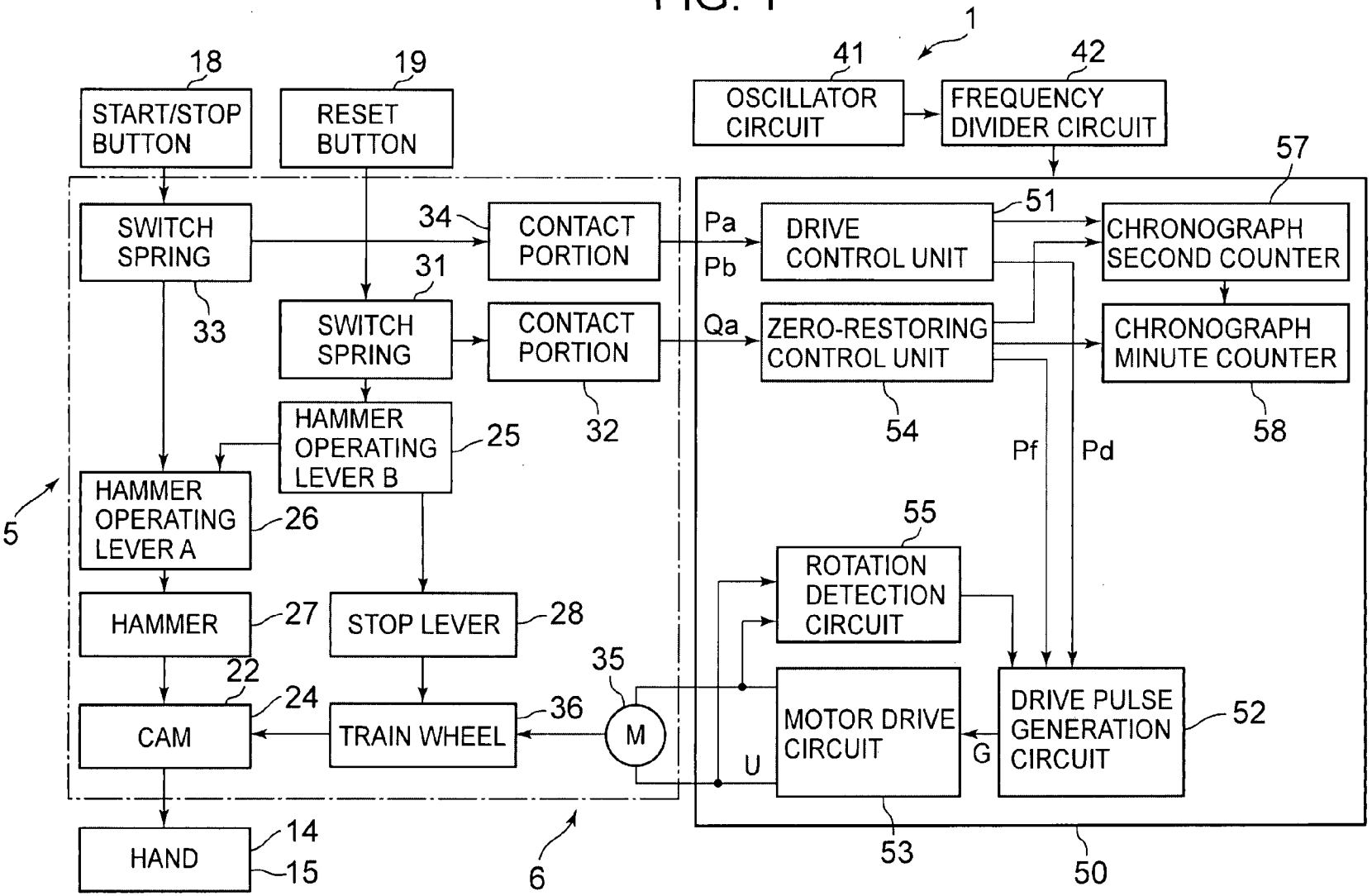
FIG. 1 is a block diagram illustrating the configuration of a chronograph timepiece according to a first embodiment of the present invention.

Next, the electrical drive mechanism 6 of the chronograph timepiece 1 will be described mainly based on the block diagram of FIG. 1 while referring to the mechanical structure 5 of FIGS. 2A and 2B. The mechanical structure 5 constitutes a mechanical control unit, and the electrical drive mechanism 6 constitutes an electrical control unit.

The rotation of the chronograph hand movement motor 35 of the chronograph timepiece 1 is controlled by a drive control integrated circuit 50 for the chronograph hand movement motor 35 drive-controlled based on clock pulses imparted via an oscillation circuit 41 and a frequency divider circuit 42.

The motor drive control integrated circuit 50 has a basic drive control unit 51, a drive pulse generation circuit 52, a motor drive circuit 53, a zero-restoring control unit 54, and a rotation detection circuit 55. Here, the drive unit for the chronograph hand movement motor 35 consists of the motor drive circuit 53, and the drive control unit for the chronograph hand movement motor 35 has the basic drive control unit 51, the drive pulse generation circuit 52, the zero-restoring control unit 54, and the rotation detection circuit 55. The basic drive control unit 51, the drive pulse generation circuit 52, and the motor drive circuit 53 constitute a control unit.

Further, the motor drive control integrated circuit 50 has a chronograph second counter 57 counting chronograph seconds and retaining the chronograph second information, and a chronograph minute counter 58 counting chronograph minutes and retaining the chronograph minute information. There may be further provided a chronograph hour counter counting chronograph hours and retaining the chronograph hour information.

The basic drive control unit 51 receives the start signal or operation signal Pa imparted via the contact portion 34 in response to the depression of the start/stop button 18 when the chronograph timepiece 1 is in the zero-restoring (reset) state S2.

Upon receiving the start signal or operation signal Pa, the basic drive control unit 51 issues a drive control signal Pd after a short period of time for preventing chattering. In the following, unless otherwise specified, the point in time when the start signal or operation signal Pa is received and the point in time when the drive control signal Pd is transmitted are substantially identical with each other. The drive control signal Pd is a signal maintained at high level throughout the period when the chronograph operation is executed.

Further, the basic drive control unit 51 stops the transmission of the drive control signal Pd upon receiving the stop signal Pb imparted via the contact portion 34 in response to the depression of the start/stop button 18 when the chronograph timepiece 1 is in the start state S1 (or when the transmission of the start signal or operation signal Pa from the contact portion 34 is stopped).

The drive control signal Pd from the basic drive control unit 51 is also imparted to the chronograph second counter 57. While the drive control signal Pd is maintained at high level, the chronograph second counter 57 receives the clock pulses imparted from the frequency divider circuit 42 and counts chronograph seconds, and, further, issues chronograph timing pulses Ph at a cycle T starting from the point in time when the time measurement as chronograph is started based on the drive control signal Pd. The cycle (chronograph hand drive cycle) T of the pulses Ph corresponds to the time measurement accuracy of the chronograph timepiece 1; for example, it is 1/100 sec (i.e., 10 ms).

Upon receiving the drive control signal Pd, the drive pulse generation circuit 52 imparts a main drive pulse G for chronograph hand drive to the motor drive circuit 53 in response to each chronograph timing pulse Ph. The motor drive circuit 53 imparts a motor drive pulse U corresponding to the drive pulse G to the chronograph hand drive motor 35 to rotate the motor 35. From this onward, the motor 35 is alternately driven by main drive pulses of different polarities to rotate by a predetermined angle at one time.

In this way, in a case where the time measurement operation start operation is performed when the timepiece is in the reset state S2 shown in FIG. 2A, the operation is performed in the following order: the operation of the start/stop button 18 in the direction A1; the releasing of setting through movement of the hammer operating second lever 26 and the hammer 27; the closing of the contact portion 34 through depression of the start/stop switch spring 33 (start state); and the generation of the start signal Pa via the contact portion 34.

Thus, it is possible to drive the motor 35 by the main drive pulses generated after the releasing of setting by the hammer 27 and the stop lever 28, so that it is possible to perform an accurate time measurement operation.

When the basic drive control unit 51 receives the stop signal Pb when the chronograph timepiece 1 is in the start state S1, the drive control unit 51 stops the transmission of the drive control signal Pd (If so desired, a drive stop signal Pf may be imparted) to stop the transmission of the drive pulses G from the drive pulse generation circuit 52, to stop the transmission of the motor drive pulses U by the motor drive circuit 53, to stop the rotation of the chronograph hand movement motor 35, to stop the rotation of the rotor or output shaft of the motor 35, and to stop the hand movement of the chronograph hands 14 and 15 via the chronograph hand movement train wheel 36.

On the other hand, when the switch spring 31 is pushed down through depression of the reset button 19 to close the contact portion 32 when the chronograph timepiece 1 is in the start state S1, the reset signal Qa is imparted to the zero-restoring control unit 54. Upon receiving the reset signal Qa from the contact portion 32, the zero-restoring control unit 54 imparts the drive stop signal Pf to the drive pulse generation circuit 52. As a result, the drive pulse generation circuit 52 stops the generation of the drive pulses G, and stops the transmission of the motor drive pulses U by the motor drive circuit 53. Thus, the rotation of the chronograph hand movement motor 35 is stopped, and the hand movement of the chronograph hands 14 and 15 is stopped. After this, the zero-restoring and the setting by the hammer 27 and the stop lever 28 are effected. Upon receiving the reset signal Qa, the zero-restoring control unit 54 resets the chronograph second counter 57 and the chronograph minute counter 58 to zero.

In this way, when the reset operation is performed when the chronograph timepiece is in the start state (or stop state) S1 shown in FIG. 2B, the operation is performed in the following order: the operation of the reset button 19 in the direction B1; the closing of the contact portion 32 through depression of the reset switch spring 31 (reset state); the generation of the reset signal Qa via the contact portion 32; the stopping of the driving of the motor 35; and the zero-restoring and setting by the hammer operating first lever 25, the hammer operating second lever 26, the hammer 27, and the stop lever 28.

Thus, the zero-restoring and setting by the hammer 27 and the stop lever 28 are effected after the driving of the motor 35 is stopped, so that it is possible to prevent the motor 35 from being placed in a non-rotation state through the setting, thus making it possible to perform an accurate time measurement operation.

As described above, according to this embodiment, there is provided a chronograph timepiece 1 comprising: a mechanical control unit releasing a mechanical setting state of chronograph hands 14 and 15 in response to a start operation of a start/stop button 18 and mechanically zero-restoring and setting the chronograph hands in response to a reset operation of a reset button 19; a contact portion 34 operating in response to the operation of the start/stop button 18; and an electrical control unit which starts a time measurement operation when the contact portion 34 is placed in a start state by a start operation of the start/stop button 18 to electrically hand-movement-drive the chronograph hands 14 and 15 and which electrically resets the time measurement operation when a contact portion 32 is placed in a reset state by the reset operation of the reset button 19, wherein the contact portion 34 is placed in the start state after the mechanical control unit releases the setting of the chronograph hands in response to the start operation of the start/stop button 18, with the electrical control unit starting the time measurement operation to electrically hand-movement-drive the chronograph hands 14 and 15; and the mechanical control unit mechanically zero-restores and sets the chronograph hands 14 and 15 after the contact portion 32 is placed in the reset state and the electrical control unit electrically resets the time measurement operation.

In this way, the timing of the electrical operation and the mechanical operation at the time of start operation and reset operation is optimized, so that it is possible to perform a normal operation. Further, before the mechanical setting with respect to the rotation of the chronograph hands is released, the chronograph hand drive motor 35 is electrically driven, making it possible to prevent the accurate hand movement from being hindered. Further, it is possible to reliably perform the mechanical drive control and the electrical drive control with a proper timing while avoiding a complicated structure and an increase in the requisite cost.

More specifically, the reset switch contact 32 is arranged in front of the position where the hammer operating first lever 25 operates, and the start switch contact 34 is arranged behind the position where the hammer operating second lever 26 and the hammer 27 operate, whereby it is possible to secure the proper order for the zero-restoring/setting after the input at the reset switch contact 32 at the time of chronograph reset operation and the input at the start switch contact 34 after the releasing of the setting at the time of chronograph start operation, thereby making it possible to prevent a non-rotation state of the motor 35 due to the setting and generation of a situation in which the hand movement is impossible.

Figure 4:
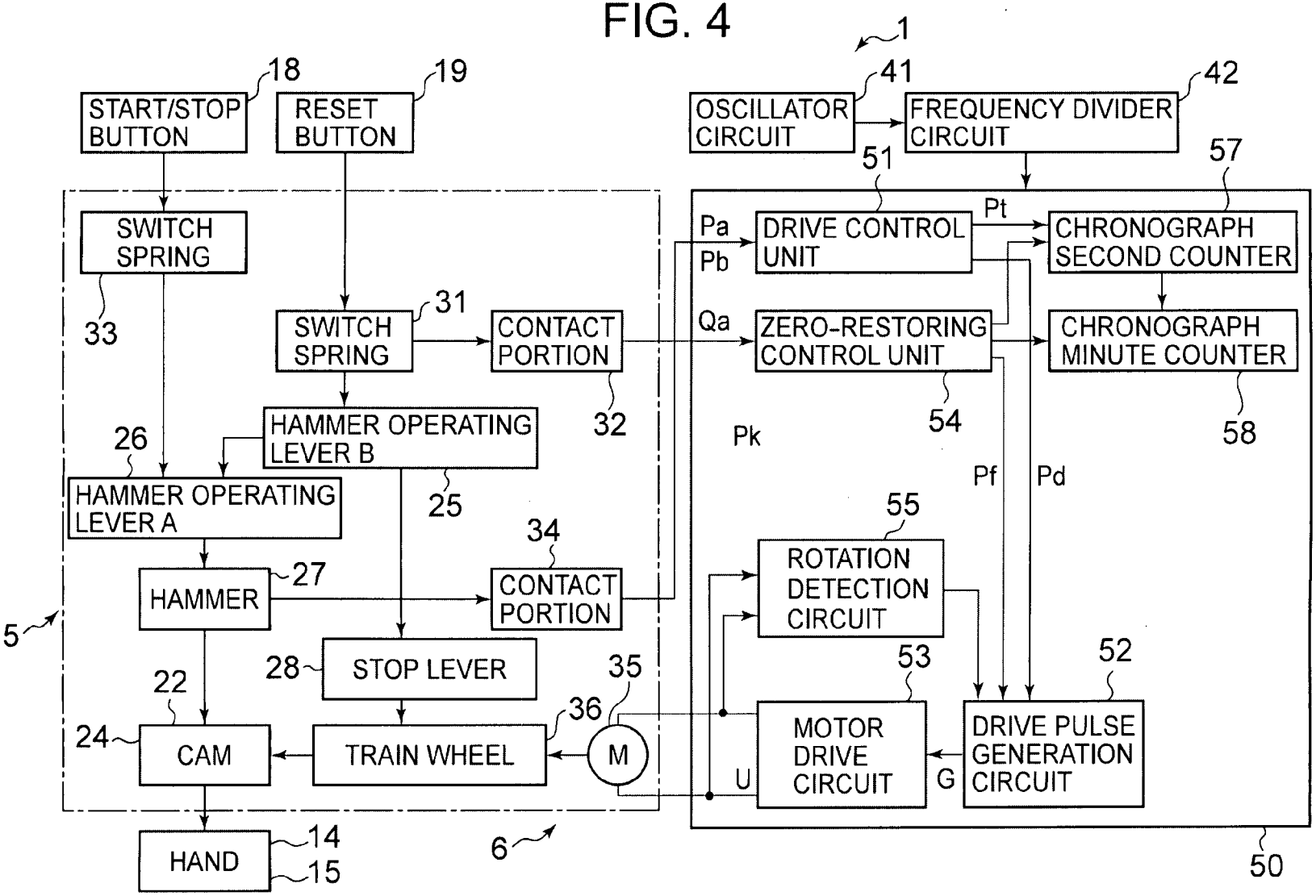
FIG. 4 is a block diagram illustrating the configuration of a chronograph timepiece according to a second embodiment of the present invention.

FIG. 4 is a block diagram illustrating the configuration of a chronograph timepiece according to a second embodiment of the present invention. The portions that are the same as those of FIG. 1 are indicated by the same reference numerals.

Figure 5A:
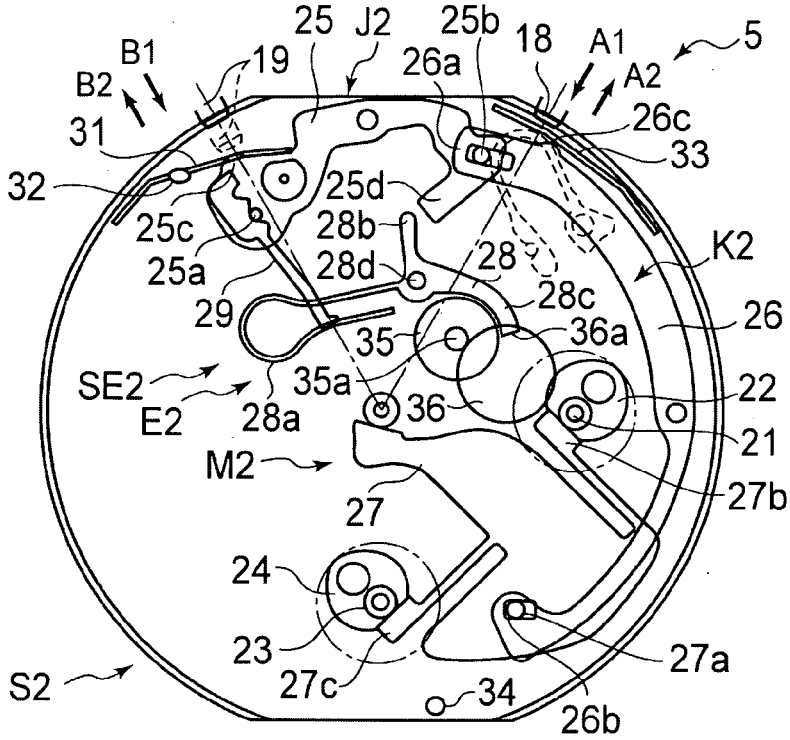
FIGS. 5A and 5B are schematic plan views of the mechanical configuration of a chronograph mechanism of the chronograph timepiece of the second embodiment of the present invention.
Figure 5B:
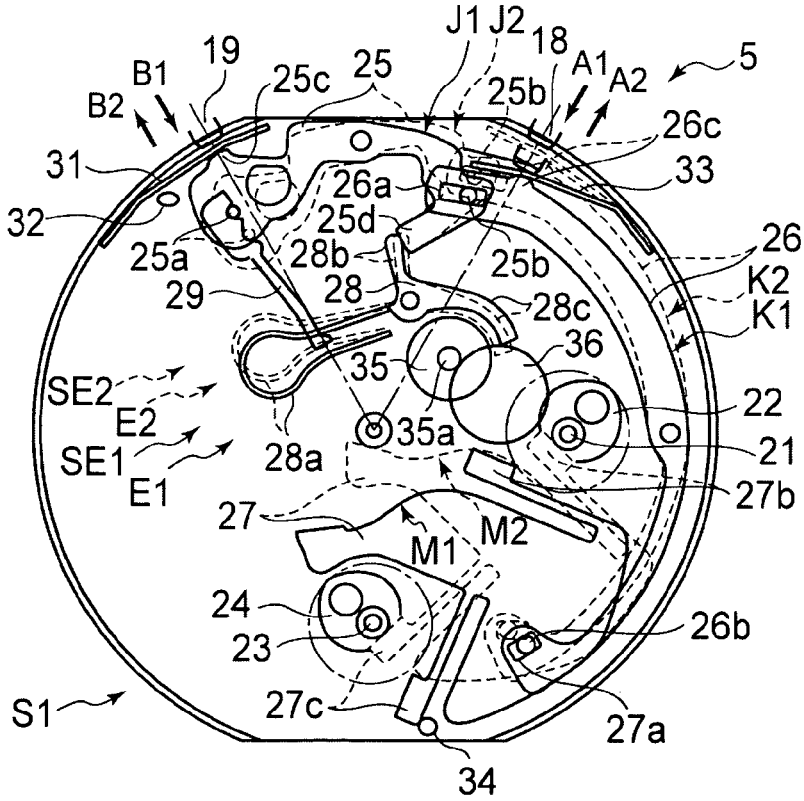

FIGS. 5A and 5B are plan views illustrating the mechanical configuration of the chronograph mechanism of the chronograph timepiece of the second embodiment of the present invention. The portions that are the same as those of FIGS. 2A and 2B are indicated by the same reference numerals. In the following, the second embodiment will be described in relation to the features where it differs from the first embodiment.

In the first embodiment, when performing the start operation, the switch spring 33 is pressed by operating the start/stop button 18 to close the contact portion 34. In the second embodiment, the switch spring 33 is pressed by operating the start/stop button 18, and the switch spring 33 moves the hammer operating second lever 26 from the zero-restoring position K2 to the reference position K1, whereby the hammer 27 is moved from the zero-restoring position M2 to the reference position M1, and the contact portion 34 is closed by the hammer 27.

Here, when the time measurement operation start operation is performed when the chronograph timepiece is in the reset state S2 shown in FIG. 5A, the operation is performed in the following order: the operation of the start/stop button 18 in the direction A1; the pressing of the start/stop switch spring 33; the releasing of setting through movement of the hammer operating second lever 26 and the hammer 27; the closing of the contact portion 34 (start state); and the generation of the start signal Pa via the contact portion 34.

Thus, the main drive pulses are supplied after the setting by the hammer 27 and the stop lever 28 has been released, making it possible to drive the motor 35 by the main drive pulses, whereby it is possible to perform an accurate time measurement operation.

When performing the reset operation in the second embodiment, an operation similar to that in the first embodiment is performed.

As described above, as in the first embodiment, also in the second embodiment, the timing of the electrical operation and the mechanical operation at the time of start operation and reset operation is optimized, so that it is possible, for example, to perform an accurate operation.

Although in the above-described embodiments the chronograph second hand is arranged on the 6 o'clock side, and the chronograph minute hand is arranged on the 9 o'clock side, the present invention is also applicable to a center chronograph using the hand 13 as the chronograph second hand.

Further, the contact portions 32 and 34 themselves may also be formed by open/close switches. In this case, the contact portions 32 and 34 constitute switch units. Further, it is also possible to form the members (the switch springs 31 and 33 and the hammer 27) moving toward and away from the contact portions 32 and 34 at the time of start/stop operation and reset operation of a conductive material, forming open/close switches by the contact portions 32 and 34 and the above-mentioned members. In this case, the contact portions 32 and 34, the switch springs 31 and 33, and the hammer 27 constitute switch units.

The present invention is applicable to various types of chronograph timepieces electrically driving time hands and chronograph hands and effecting setting by a mechanical mechanism so as to prevent movement of the chronograph hands in the reset state, with the driving of the chronograph hands being effected after the releasing of the setting by the mechanical mechanism.

What is claimed is:

1. A chronograph timepiece comprising: a mechanical control unit releasing a mechanical setting of a chronograph hand in response to a start operation of an operation unit and mechanically zero-restoring and setting the chronograph hand in response to a reset operation of the operation unit; a switch unit operating in response to the operation of the operation unit; and an electrical control unit which starts a time measurement operation to electrically hand-movement-drive the chronograph hand when the switch unit is placed in a start state through the start operation of the operation unit and which electrically resets the time measurement operation when the switch unit is placed in a reset state through a reset operation of the operation unit, wherein the switch unit is placed in the start state after the mechanical control unit releases the setting of the chronograph hand in response to the start operation of the operation unit, and the electrical control unit starts the time measurement operation to electrically hand-movement-drive the chronograph hand; and the mechanical control unit mechanically zero-restores and sets the chronograph hand after the switch unit is placed in the reset state and the electrical control unit electrically resets the time measurement operation in response to the reset operation of the operation unit.

2. A chronograph timepiece according to claim 1, wherein the mechanical control unit is equipped with a first lever unit moving in response to the start operation of the operation unit to release the setting of the chronograph hand, and a second lever unit zero-restoring and setting the chronograph hand in response to the reset operation of the operation unit; and the switch unit is placed in the start state after the first lever unit releases the setting of the chronograph hand, and is placed in the reset state before the second lever unit zero-restores and sets the chronograph hand.

3. A chronograph timepiece according to claim 2, wherein the first lever unit has a hammer operating second lever moving in response to the start operation of the operation unit, and a hammer setting the chronograph hand and moving with the movement of the hammer operating second lever to release the setting; and the switch unit has a switch spring moving in response to the start operation of the operation unit, and a contact portion placed in a start state by being pressed by the switch spring.

4. A chronograph timepiece according to claim 2, wherein the first lever unit has a hammer operating second lever moving in response to the start operation of the operation unit, and a hammer setting the chronograph hand and moving with the movement of the hammer operating second lever to release the setting; and the switch unit has a contact portion placed in a start state by being pressed by a hammer.

* * * * *